United States Patent [19]

Heath et al.

[11] 4,286,929

[45] Sep. 1, 1981

[54] DUAL PRESSURE GAS MOTOR, AND METHOD OF OPERATION

[75] Inventors: Rodney T. Heath, 4901 E. Main, Farmington, N. Mex. 87401; C. Richard Gerlach, San Antonio, Tex.

[73] Assignee: Rodney T. Heath, Farmington, N. Mex.

[21] Appl. No.: 36,839

[22] Filed: May 7, 1979

Related U.S. Application Data

[63] Continuation-in-part of Ser. No. 780,479, Mar. 23, 1977, abandoned.

[51] Int. Cl.[3] ..... F04B 17/00; F01L 21/04

[52] U.S. Cl. ..... 417/404; 91/224; 91/226; 91/229; 91/164

[58] Field of Search ..... 91/164, 222, 224, 226, 91/229, 234, 303, 342; 417/403, 404

[56] References Cited

U.S. PATENT DOCUMENTS

| | | | |
|---|---|---|---|
| 134,212 | 12/1872 | McConnell | 91/303 |
| 186,539 | 1/1877 | Carr et al. | 91/164 |
| 257,280 | 5/1882 | Blessing | 91/226 |
| 422,157 | 2/1890 | Riekie | 91/164 |
| 520,456 | 5/1894 | Sparr | 91/164 |
| 683,523 | 10/1901 | Thomson | 91/164 |
| 1,045,441 | 11/1912 | Romick, Jr. | 91/164 X |
| 1,142,551 | 6/1915 | Burnhart | 91/226 |
| 1,627,427 | 5/1927 | Cook | 91/164 X |
| 2,862,478 | 12/1958 | Staats | 417/403 X |
| 3,010,439 | 11/1961 | Mee et al. | 91/226 |
| 3,019,735 | 2/1962 | Moeller et al. | 91/308 X |
| 3,700,360 | 10/1972 | Shaddock | 417/404 |
| 3,846,049 | 11/1974 | Douglas | 417/404 |

FOREIGN PATENT DOCUMENTS

| | | | |
|---|---|---|---|
| 1143699 | 10/1957 | France | 91/229 |
| 117851 | 12/1946 | Sweden | 91/229 |

*Primary Examiner*—Leonard E. Smith
*Attorney, Agent, or Firm*—Richard D. Law

[57] ABSTRACT

A cylindrical shell with a double acting piston, having a high pressure area and a low pressure area on each side thereof, is provided with a valve for alternately injecting high pressure gas to each small area to provide an initial piston drive, and valving for injecting gas under the pressure, opposite from the first high pressure end to the opposite larger area providing a secondary piston drive using expansion of the high pressure expanded gas from the opposite end of the piston. In reversing the piston, the opposite end becomes the drive end in the same manner. In one form, a two position slide valve, initially actuated by piston movement and completed by gas pressure movement, provides a transfer means for gas streams internally of the motor and for exhaust of the secondary expanded gas. The valve is arranged for an initial mechanical movement from one position toward the other position by contact with the end wall of the low pressure cylinder and then completely moved to other position by gas pressure. This arrangement permits a very slow piston reciprocation without stalling.

9 Claims, 8 Drawing Figures

DUAL PRESSURE GAS MOTOR, AND METHOD OF OPERATION

This application is a continuation-in-part application of copending application Ser. No. 780,479, filed Mar. 23, 1977, now abandoned, for Dual Pressure Gas Motor and Method of Operation.

The present invention relates to gas driven reciprocating motors, particularly for driving liquid pumps, however, such motors may be used for driving other types of devices from its reciprocating piston rod.

The invention may be classified as a free valve, gas operated motor, and may be considered as a compound, two-stage-gas-drive reciprocating motor, and hereafter the invention may sometimes be referred to simply as motor.

High pressure air or gas has been used to operate various types of motors, pumps or machinery, and it is known to be desirable to take advantage of the expansion of the gas from its initial high pressure to a low pressure and thereby use some of the pressure energy in the gas. In the use of gas operated motors, it is sometimes necessary to use more than one stage in the motor to take a further economical advantage of the two stage expansion of the high pressure gas. Commonly, dual acting pistons have been used for two stage motors, and for more sophisticated motors two or more pistons have been used, with each piston driving a reciprocable pump.

High pressure, natural gas is commonly used for operating a motor for pumping glycol in a well-head dehydrator installation, wherein gas is separated from the water and the hydrates in the gas. The operation involves pumping glycol as a dehydrator for the gas, and the glycol is circulated between a gas contact chamber under high pressure to a regenerator-drier where the water is removed from the glycol from a lower pressure. Gas power motors and glycol pumps have heretofore been used for this purpose. The depletion of cheap natural gas, however, has required a change in this procedure, and has created a substantial need for a more efficient gas powered motor. More importantly, the gas source for the wellhead pumps, which were in past years at comparatively high pressure, such as a thousand pounds per square inch or more, are generally now at much reduced pressures. Thus, few problems were previously encountered in using gas powered motors for glycol pumps in wellhead treaters, but at the present, many of the established gas sources, now at the lower pressures, render the conventional gas powered motors for the glycol pumps unsuitable and inefficient for purposes at hand.

PRIOR ART

The compound steam or gas engine shown in U.S. Pat. No. 1,627,427 has a two stage piston, which is a double acting piston for both the high pressure and the low pressure stages. The major concept of the invention is to mechanically control the action of the valve which controls the movement of the piston. This engine uses a steam chest with a reciprocable sleeve which acts as a valve, that is mechanically positioned by a controlled rod to determine the operation of the engine as (1) a compound high and low pressure engine, (2) as a high pressure engine of reduced power, or (3) as a high engine of maximum power. The actual operation of the piston controls the movement of the engine slide valve by mechanical movement of a push-pull rod connected to the slide valve. The patentee states that the entire internal valve is reciprocated lengthwise by means of the push-pull rod, which in turn is reciprocated by an eccentric mounted on piston rod.

In U.S. Pat. No. 3,846,049, a pilot valve is mechanically shifted by a push-pull rod from a single stage hydraulic motor to change the flow of hydraulic fluid to one side or the other of piston of the hydraulic motor. The pilot valve acts to shift a spring loaded slide valve which alternately introduces hydraulic pressure into one chamber of the piston motor while releasing hydraulic fluid from the other chamber of the piston motor. Neither the pilot valve nor the spring loaded slide valve is free.

U.S. Pat. No. 134,212 shows a tappet rod for reciprocating the distributing slide valve of a piston motor. Carr et al U.S. Pat. No. 186,539 reciprocates a slide valve to a piston, reciprocating motor by a rocker actuated push-pull rod. The rocker is actuated by the piston of the motor. Thomson U.S. Pat. No. 683,523 shows a compound, single acting, high pressure one side and single acting low pressure other side piston motor. The slide valve of the motor is moved by a push-pull rod bearing against an eccentric fitted on the motor shaft.

The hydraulic tandem piston pump of Shaddock U.S. Pat. No. 3,700,360 uses solenoids to actuate a pilot valve for moving a spring centered spool valve. Staats U.S. Pat. No. 2,862,478 uses a spring powered valve rod to shift hydraulic fluid from one side to the other side of a single stage double acting piston motor. The outlets from each cylinder end are open to a common outlet manifold which exhausts out a common outlet line. Due to the open outlet ports this motor would probably not be operatable without check valves or the like in the outlet ports.

Other gas motor disclosures show various types of units, for example, French Pat. No. 1,143,694 using a compound, two separate pistons, gas motor, with each piston having its own slide valve shows one type. Moeller U.S. Pat. No. 3,019,735 shows a two piston, each single acting, motor-pump combination requiring 3 separate slide valves for operating the single pistons transferring gas from chamber to chamber of the piston motors. This is accomplished by the piston, with an attached eccentric actuating the push-pull rod of the valve, exemplified by railroad steam engines. The second type gas or hydraulic motors which do not have an external means (usually a push-pull rod) to actuate the slide valves must operate at a high speed, and these have complicated valving arrangements, and are not automatic operating motors suitable for remote unattended use.

OBJECTS AND ADVANTAGES OF THE INVENTION

Included among the objects and advantages of the present invention is to provide a compound, two stage drive piston motor, of a reciprocating piston type, which is arranged in a manner that produces an automatic, slow speed continuous pumping action, using gas at two pressure levels for expansion to drive a gas motor, for operating piston pumps, and other types of machinery from a reciprocating piston rod.

Another object of the invention is to provide a two stage gas driven, reciprocating piston motor of simple design, which may be easily manufactured, and simply and easily maintained.

Still another object of the invention is to provide a compound, two stage, reciprocating piston motor, which is especially suited for operating at low speed, for actuating piston type fluid pumps, particularly pumping glycol or other fluid.

Yet another object of the invention is to provide a novel, improved gas operated, reciprocating piston motor which may operate through the expansion of the driving gas, and which is easily adapted to operate automatically at a wide range of different available gas pressures.

An additional object of the invention is to provide an improved gas operated motor which will provide maximum expansion of the driving gas to minimize the quantity of gas required for the operation of the motor, and includes a slide valve design permitting slow speed reciprocation of the piston without stalling.

Other objects of the invention are to provide an improved compound two stage gas operated motor which is rugged and durable, reliable and capable of operating for long periods of time without maintenance, and which may be readily and easily controlled as to speed of reciprocation of the piston under various pressure conditions.

These and other objects and advantages of the invention may be readily ascertained by referring to the following description and appended illustrations:

GENERAL DESCRIPTION OF THE ILLUSTRATIONS

DETAILED DESCRIPTION OF THE ILLUSTRATION

In accordance with the invention, a cylindrical piston is mounted for reciprocation in a cylinder housing with a piston rod extending from one end of the housing to provide activation of a driven unit. The drawings are illustrated with a combined motor and a liquid pump. This is one method of the use of the motor of the invention. Other types of driven units may be driven from the piston rod.

The slide valve configuration with the gas passages is critical to slow speed operation of the motor without stalling. In a cycle, where the piston assembly is moving in one direction under the influence of gas on the piston, it is important to mechanically move the slide valve (by contact with a cylinder wall) for the initial phase where exhausting gas from the chamber is stopped and expanding gas is admitted while the piston is still reciprocating in the one direction, so that the slide valve is fully actuated the opposite direction by gas pressure, while the piston continues in the one direction to the end of its stroke. Unless the double actuation occurs during the oneway movement of the piston, the motor will stall.

Figure 1:
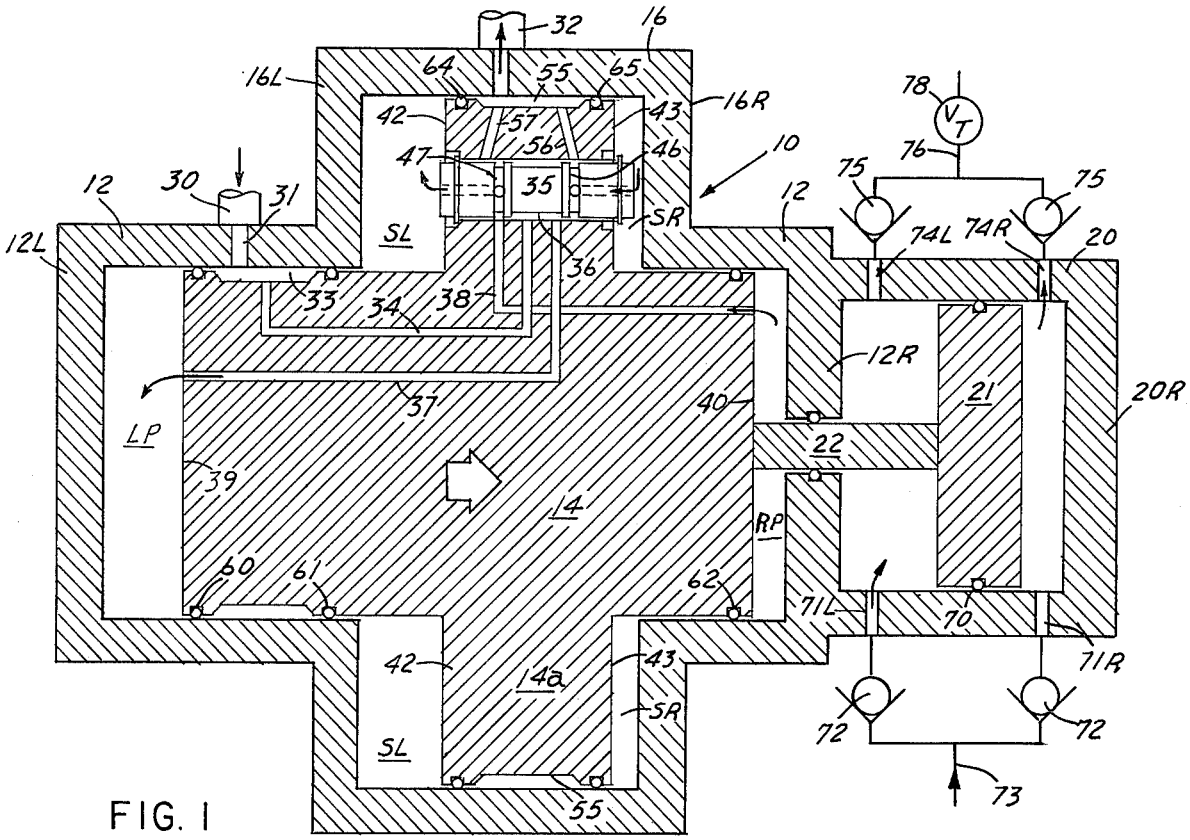
FIG. 1 is a cross-sectional, side elevation of a motor according to the invention, in one position of action.

In the device illustrated in FIG. 1, a shell housing 10 for a gas motor, provides a primary cylinder section 12 in which a cylindrical double acting piston assembly 14 reciprocates. A centrally disposed, circumferential section 16 of the housing provides means for the reciprocation of an integral, second stage, double acting secondary, piston assembly **14*a* mounted centrally on the piston 14. A pump housing 20 is integrally mounted with the housing 10 joining the left side of section 12, and this housing provides for the reciprocation of a piston 21 of the pump connected, by means of a piston rod 22, to one end 40 of the motor piston 14. Thus, the piston 21 reciprocates jointly with the reciprocation with the piston 14**. The pistons are cylindrical, reciprocating in cylindrical cylinders and the pistons are free to rotate in the housing.

Figure 3:
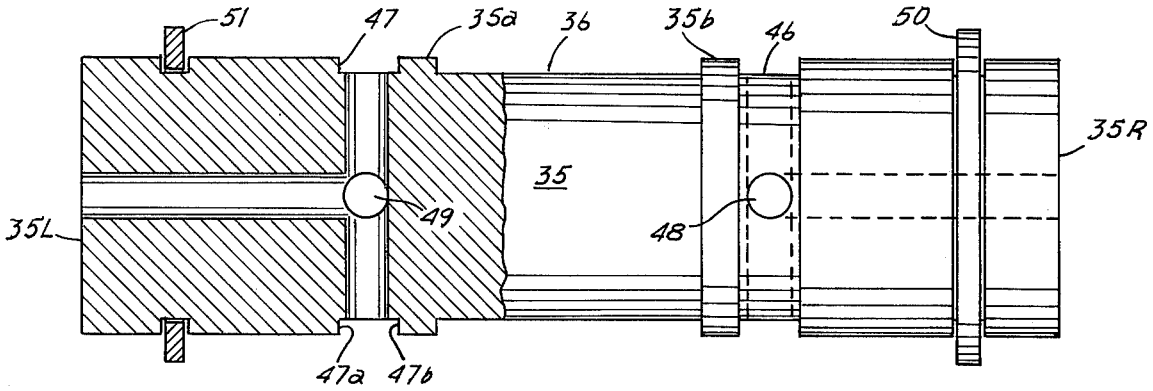
FIG. 3 is a cross-sectional, side elevation of a slide valve for controlling internal gas flows in the motor of the invention.
Figure 4:
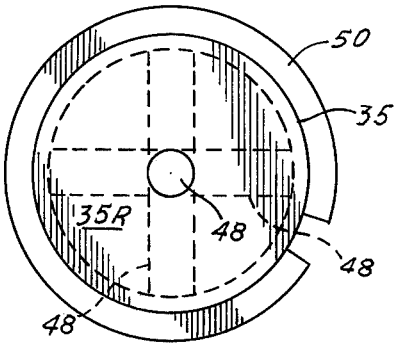
FIG. 4 is an end elevation of the slide valve of FIG. 3.
Figure 5:
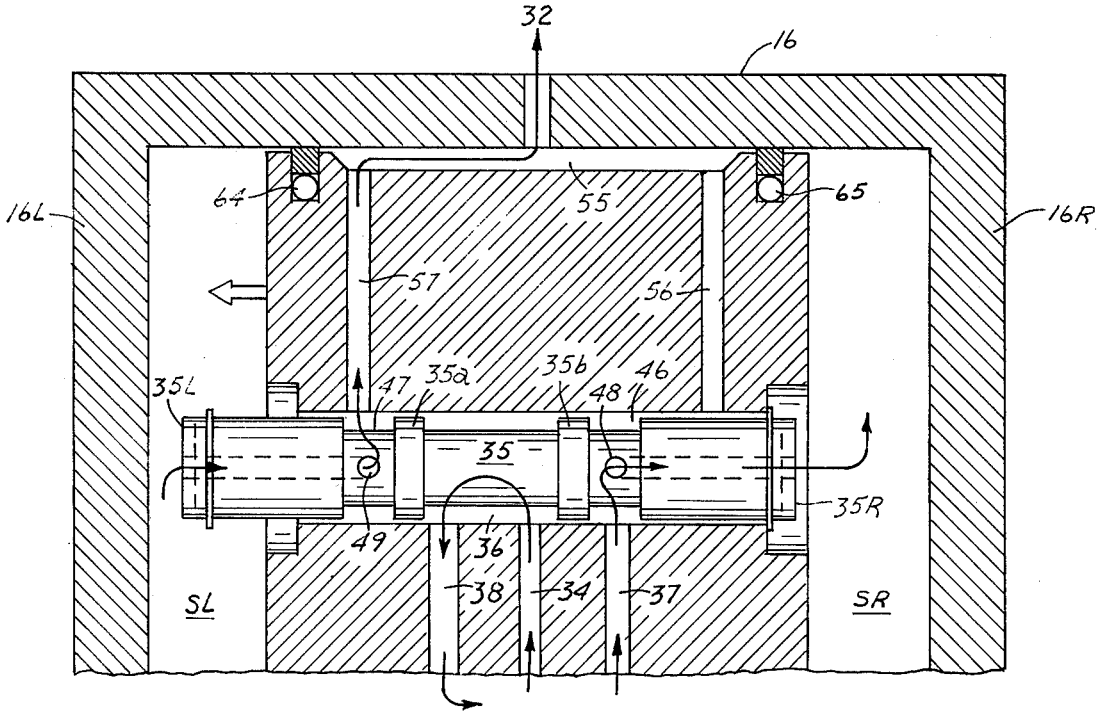
FIG. 5 is a schematic, detailed cross-section of the slide valve of the motor of FIG. 1 in a first phase of a cycle of the reciprocating motor.

The motor is provided with a gas inlet 30 and a gas outlet 32. The inlet 30 communicates at all times, by means of an internal inlet passage 31, through the housing into annular passage 33 in the left end of the piston. The arrangement provides inlet gas completely around the circumference of the piston. The annular passage 33 is connected by means of an interior passage 34, through the piston, to a circular passage reciprocably housing a slide valve 35, illustrated in large detail in FIG. 3. The inlet passage 34 is in continuous communication with an annular groove 36 around the center portion of the valve 35 and defined by lands **35*a* and 35*b*. The inlet gas passage is arranged to be in communication with the annular groove at all times, to provide a continuous supply of incoming high pressure gas into the groove 36. A passage 37 in the piston 14 routes from a point adjacent the port or outlet of passage of 34 to left end 39 of the piston 14, providing a passage for gas into and from a chamber LP at the left end of the piston. A primary chamber LP is formed by a cylinder head 12L at the end of the housing enclosing the left end of the cylinder 12 and the piston end 39. In a similar manner, a passage 38 starting adjacent the port or outlet of passage 34, extends thru the piston 14 to an outlet in right end 40 of the piston 14 into the right primary chamber RP formed by the end of the piston 40 and cylinder head 12R closing the chamber RP. While the slide valve 35 is arranged so that passage 34 is always in contact with the circumferential groove 36, the passages 37 and then 38 will alternately be in contact with the groove 36, to alternately provide high pressure (incoming) gas into the primary chambers at either end of the piston 14. The secondary, integral piston 14*a* is provided with an end area 42 at the left end and an end area 43 at the right end, which provide secondary chambers SL and SR, respectively with the cylinder closures or heads 16L and 16R, at each end of the secondary housing 16. The secondary piston 14*a* provides the chamber SL, defined by the left end 42, annular cylinder 16 and ring shaped head 16L. On the opposite side of the secondary stage of the motor, chamber SR is defined by the piston end 43, cylinder 16 and the ring shaped head 16R**.

On either side of the annular groove 36 on the slide valve is an adjacent small annular groove. These are a groove 46 at the right side and a groove 47 at the left side. Bore 48 in the groove 46 is an inlet to passage 48 providing a passage from the groove to the valve end 35R. In a similar manner, a bore 49, starting at the bottom of the groove 47, extends through the slide valve to the end 35L. A snap ring retainer 50 is mounted in a groove adjacent the right end of the valve, and a snap ring retainer 51 is mounted in a groove adjacent the left end of the valve, to limit motion of the reciprocating valve in its circular passage in the secondary piston 14A.

An outer annular groove 55 is located in th peripheral, circumferential surface of the secondary piston 14A, and it communicates by means of passage 56 at the right side and passage 57 at the left side with the slide valve bore. The passages 56 and 57 communicate with annular grooves 46 and 47 when aligned therewith. The piston 14 is sealed in the cylinder 12 by means of outer seal rings 60 and 61 (on opposite sides of groove 33) at the left end, and a seal ring 62 adjacent end 40 at the piston's opposite end. In a similar manner the secondary piston is sealed by seal ring 64, at one side, and seal ring 65 at the opposite side.

The piston of the pump 21 reciprocates in the chamber of the cylinder 20, and the outer end of the cylinder 20 is sealed by an end wall or head 20R. The piston is sealed in the cylinder by means of a seal ring 70. The pump piston is a double acting piston, and is provided with inlets 71R and 71L respectively to right and left pump chambers. Each inlet is provided with a check valve 72 in a line connected to a common liquid inlet or feed line 73. The pump is, also, provided with an outlet for each chamber in the form of passages 74R and 74L, which pass through check valves 75 to a common outlet 76, variously closable by throttle valve 78, all in conventional manner.

The general operation of the motor is as follows:

High pressure gas enters thru inlet 30 into the passage 31 and then into the annular groove 33. This provides gas at inlet gas pressure into line 34 and the groove 36 in the valve, for passage into either the passage 38 or 37. In the position of the valve of FIG. 1, the annular groove 36 is arranged to direct high pressure gas through the passage 37 into the chamber LP at the left end of the piston. Gas from the previous stroke or cycle in chamber RP passes through the passage 38, which is in contact with the groove 47, so that the gas passes through the slide valve passage 49 into the chamber SL.

Figure 2:
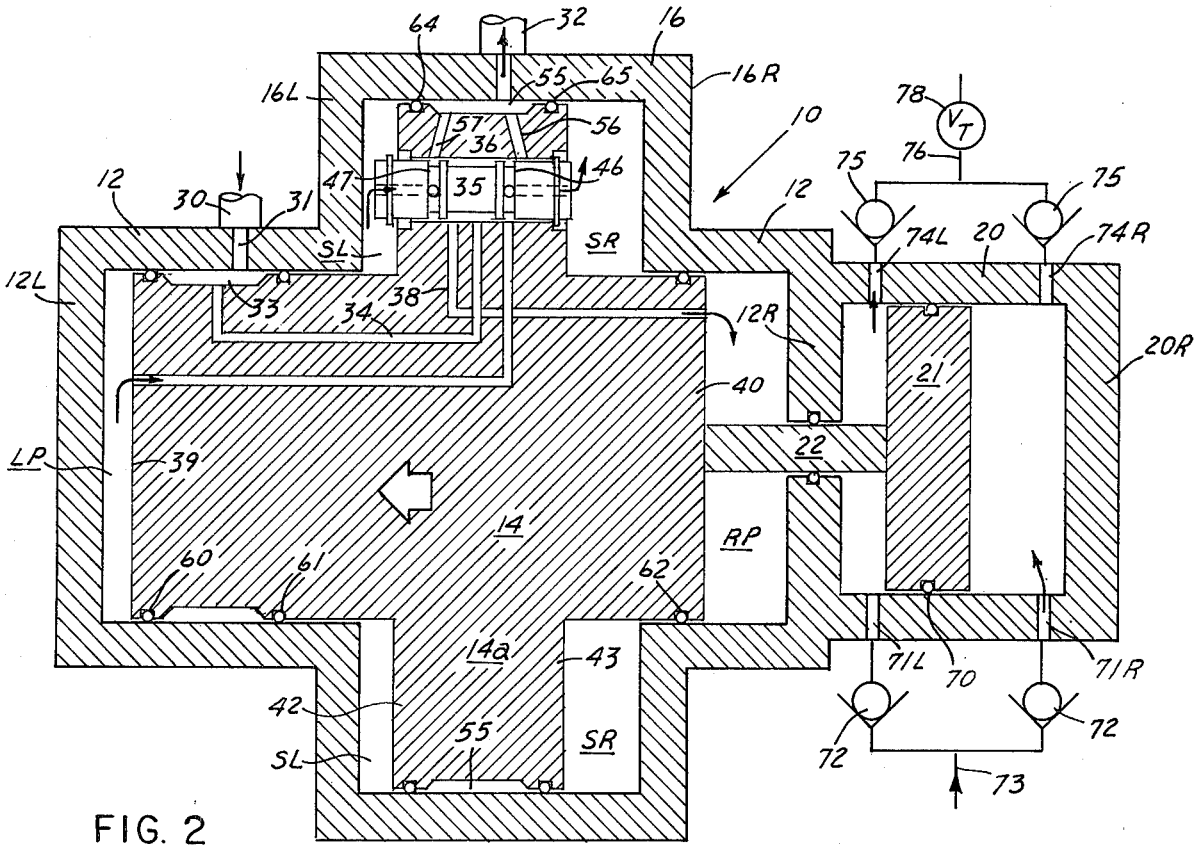
FIG. 2 is a cross-sectional, side elevation of the motor in FIG. 1, in a second position of action.

The surface area of primary piston end 39 or 40 is substantially less than the area of either side 42 and 43 of the secondary piston. For example, the area of the piston end 39 is substantially less than the area of piston end 42 of the secondary piston, and the area of the end of secondary piston 43 is larger than the area of the piston end 40. Thus, as high pressure gas enters the chamber LP, at a constant, approximate inlet pressure Ps, it initiates movement of the piston to the right as indicated by the arrow. This continues until slide valve 35 is mechanically, and by gas pressure, moved to the left before the end of the piston stroke, cutting off the incoming gas. The piston, by one or the other primary chambers, is subject to full pressure of the incoming gas for a substantial portion of its stroke. Any gas in the chamber RP (from the previous stroke) passes through passage 38 into the passage 49 and expands into the chamber SL, where expansion of the gas against the larger piston area aids in forcing the piston to the right. At the same time the outlet 56 is in communication with the groove 46 and gas in chamber SR passes through the passage 48 and out to the passage 56 into the groove 55 and thru the outlet 32. Thus, as high pressure gas is introduced at an inlet pressure into the chamber LP, the secondary chamber SR is exhausting gas through the outlet, while gas in chamber RP is passing into chamber SL for expansion and a secondary power force on the piston. The piston on its travel to the right causes the valve 35 to contact the wall 16R and the slide valve is pushed to the left changing the communication of the passages of the valve, as shown in FIG. 2. With the valve 35 shifted to the left, the high pressure gas is now introduced into chamber RP through the passage 34 into the groove 36 and through the passage 38 into the chamber RP. In the meantime gas in chamber SL has exhausted through the outlet 32 via passage 49, groove 47 and groove 55, while the gas in chamber LP passes through the passage 37 into the chamber SR to provide additional power for the stroke. There is, therefore, a net increase in the force acting on the two stage piston. The forces which combine are the incoming gas pressure acting on the ends of the primary piston 14, and the gas exhausting from the ends of the primary piston 14 to expand against the areas of the secondary piston 14A, thus providing additional work but at a lower pressure than the initial pressure entering the inlet through 30. Detailed valve action in a cycle is given below.

The proper automatic and efficient operation of the pump, particularly at very low operating speeds, is dependant on the configuration of the completely free slide valve, and the proper shifting cannot be done totally by mechanical action (wall contact and piston movement) mainly the movement of the motor piston. A pressure force must be used to complete the valve shifting action after an initial mechanical movement, making the motor an internally actuated, automatic piston motor.

Figure 6:
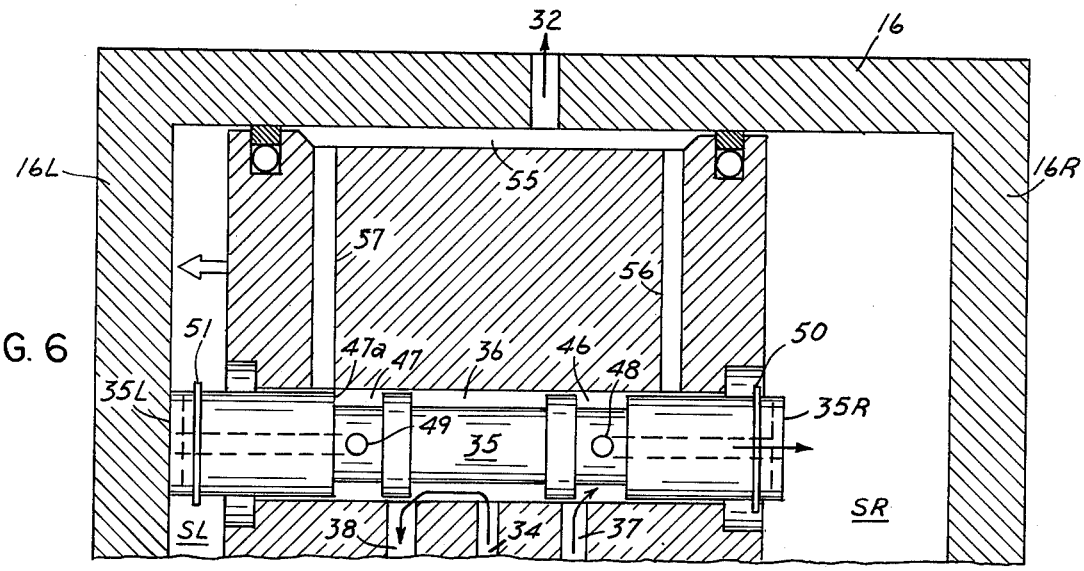
FIG. 6 is a detailed cross-section of the slide valve of the motor upon its initial contact with the chamber wall in a second phase of a cycle of the reciprocating motor.
Figure 7:
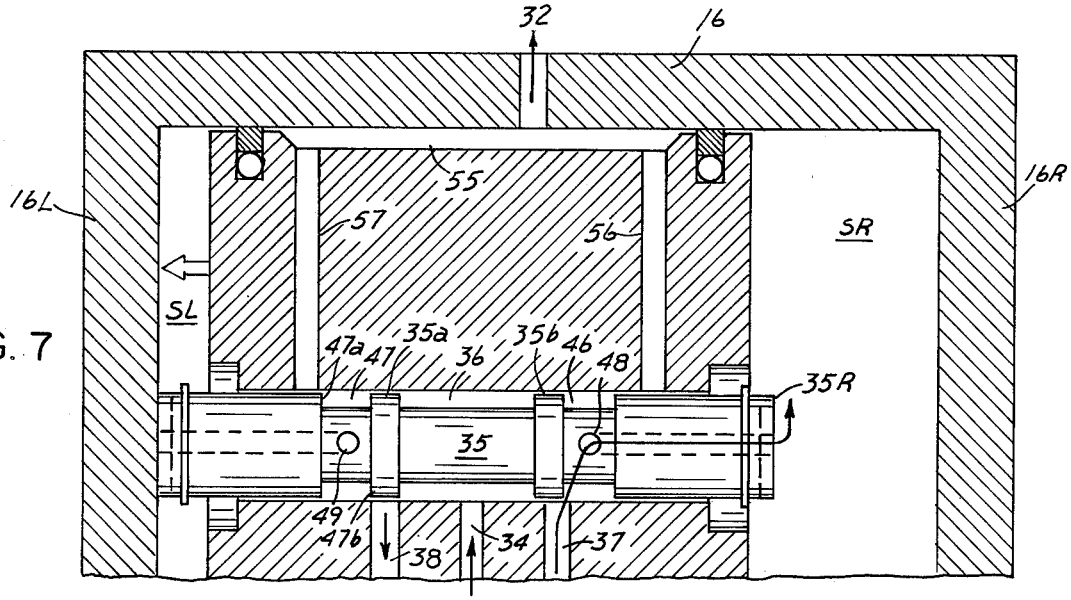
FIG. 7 is a detailed cross-section of the slide valve of the motor in a third phase of a cycle of the slide valve action.
Figure 8:
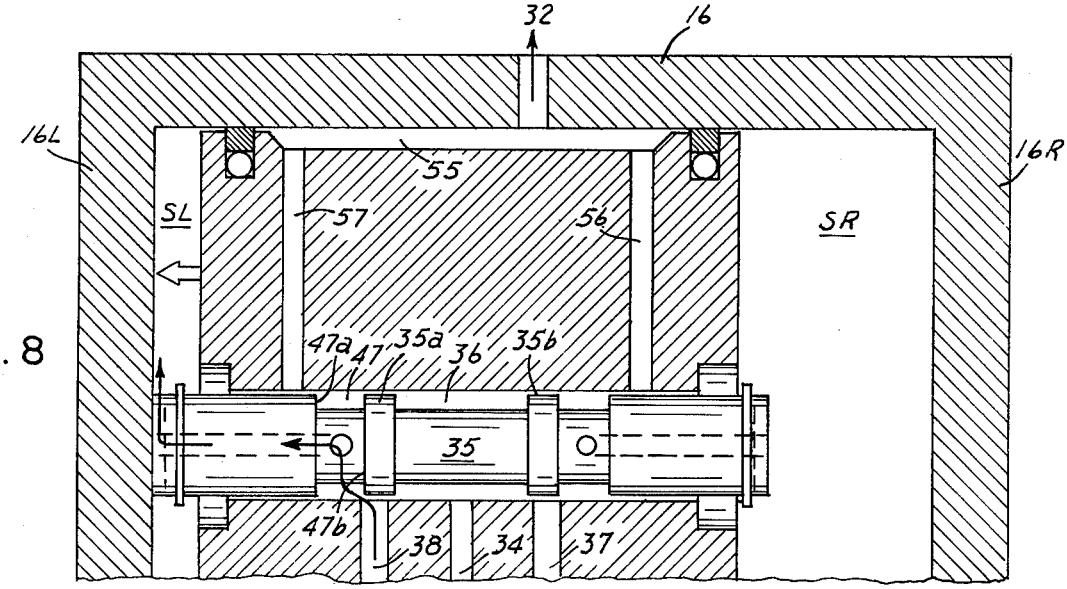
FIG. 8 is a detailed cross-section of a slide valve of the motor in a final state of the cycle.

The design of the valve is critical for the slow, automatic functioning of the motor. The sequence of operation is shown in FIGS. 5–8. At one point in a cycle, shown in FIG. 5, the piston is moving to the left, indicated by the arrow, wherein the right primary chamber RP is being charged with high pressure gas from passage 34 passing the valve through annular passage 36, formed by lands 35*a* and 35*b*, into passage 38. The left primary chamber LP is communicating through passage 37 into passage 48 of the valve and into the right secondary chamber SR. The left secondary chamber SL is exhausting through passage 49 in the valve to annular passage 47. From passage 47 the exhausting gas goes out passage 57 to annular passage 55 then out the outlet 32. In FIG. 6, the first valving sequence of the cycle occurs after initial contact of the valve end 35L with the left head wall 16L. The valve shifts slightly to the right (as the piston continues left) until the edge 47*a* (one side of the annular passage 47) exactly closes the port to the exhaust passage 57. The gas remaining in SL chamber is now trapped and is compressed slightly as the piston moves left to its limit of movement. As the piston continues to move left, the valve is pushed to the right to the condition of FIG. 7. In this condition land 35*a* completely closes passage 38, while gas from the left primary continues to pass from passage 37 into chamber SR. The edge 47*b* is at zero lap with the port of passage 38 completely shutting passage 38. The primary chamber RP is no longer receiving high pressure gas from the passage 38, while the gas in chamber SL is still trapped and still undergoing slight compression. The final phase of the valve shift is shown in FIG. 8. The edge 47*b* of land 35*a* opens slightly to passage 38, permitting high pressure gas from primary chamber PR into secondary chamber SL. The pressure in opposite secondary chamber SR is only a fraction of the higher pressure gas entering chamber SL, so that the pressure differential between the two secondary increases, and the greater pressure in chamber SL causes the valve to move suddenly to the right against the lower pressure in chamber SR. Because of the unbalanced force the valve moves completely to its far right position. The piston continues to move to the left after the valve has moved to the right, and the piston reverses at the end of the left movement because of high pressure, incoming gas in chamber LP, and the primary expanded gas from chamber RP going into secondary chamber SL. The end of the cycle is on the reversal of the piston, and a second cycle commences, as described above, except the action is to the left.

The design of the valve configuration in conjunction with the ports of the passages, cause the initial valve movement as a mechanical movement of the valve by impingement or stepping on the chamber wall while the piston is moving toward the wall. The pressure differential between the two upper secondary chambers causes the sudden pressure shift of the valve in the same direction. The mechanical movement is necessary for the initial changing of the ports, and to change gas pressure differentials in the secondary chambers causing the gas the pressure movement of the valve. This is critical to the slow operation of the motor, especially in the speed range below about 50 cycles per minute, and particularly in the very low speed ranges of 5–15 cycles per minute.

It is preferable to have the passages in the motor of sufficient size to provide a low pressure drop of the gas passing through the passages. Particularly it is preferable to have the openings to the outlet sized so that the gas pressure is almost immediately reduced in the chambers SR and SL when connected to the outlet.

In the action of the pump, when the piston 21 is traveling to the right side, the inlet check valve is closed and the liquid under pressure is forced off through the outlet passage and 74R check valve into the common outlet 76. On the opposite side of the piston there is an intake stroke wherein the outlet check valve is closed, the inlet check valve is open, and liquid is pulled into the chamber. As the piston reverses, the action is reversed so that liquid is forced out of the chamber on the left side and liquid is drawn into the chamber on the right side, as is conventional with reciprocating piston pumps.

By the use of a throttle valve 78 on outlet line, the pressure of the outlet liquid may be controlled to control the speed of the pump. By restricting the outlet line, the speed of the pump (and motor) is reduced. The pump may pump liquid or gas, depending on the unit. Also, the piston rod may be used to drive other types of machinery using a reciprocating motion for the drive.

The speed of the pump may also be controlled by throttling the inlet gas supply using a conventional throttle valve (not shown).

What is claimed is:

1. A method of operating a gas motor having a double acting, two stage piston assembly of a primary piston and a centrally mounted secondary piston, and having a single free slide valve freely reciprocably mounted in the secondary piston and arranged to pass gas from an inlet to a first side of the first stage piston and simultaneously passing gas from the second side of the first stage piston to the first side of the secondary piston, while exhausting gas from the second side of the secondary piston, comprising:

(a) completely closing the gas exhaust outlet from the first end of the secondary piston while the piston assembly is moving in a first direction, (b) exhausting gas from the second end of the secondary piston while the piston assembly is moving in said first direction, and (c) simultaneously admitting pressurized gas to the first end of the primary piston while exhausting gas from the second end of the secondary piston to product a gas pressure differential sufficient to fully move the slide valve by the gas pressure in the opposite direction while the piston assembly is moving in said first direction.

2. A method of claim 1, wherein the closing of the exhaust outlet is by the movement of a slide valve mounted in the secondary piston.

3. A method of claim 1, wherein the pressurized gas of second end of the primary piston is passed to the first end of the secondary piston.

4. In a gas actuated piston-type motor arranged for automatic, slow speed reciprocation, which has a piston assembly mounted in housing means having inlet gas means and spent gas outlet means, with the piston assembly including a double acting, primary piston having first and second ends and an integral centrally mounted double acting secondary piston thereon having first and second ends and the piston assembly is mounted for movement toward and away from cylinder heads in said housing means, and a slide valve mounted in a bore in the secondary piston, therebeing passages in the primary piston passing gas to the slide valve which alternately passes gas through passages in the primary piston to the first and second primary piston ends, and passages in the slide valve alternately receiving gas from the primary piston ends and passing gas from the opposed secondary piston ends to the outlet, the improvement of:

(a) a slide valve freely reciprocable in said secondary piston having a length longer than the length of the bore in the secondary piston so as to extend beyond either end of the secondary piston end when in full movement position, (b) said slide valve having a central passage at each end communicating with an inlet spaced from each end and having a first land at each end extending from the end to each adjacent said inlet positioned to close the outlet passage from each end of the secondary piston end while the piston assembly is moving toward the end of contact by the slide valve with the adjacent cylinder head and such closure being complete at the contact by gas pressure during the movement of the piston assembly toward the cylinder head and to open the outlet passage from the opposite second end of the secondary piston during said movement of the piston assembly, (c) said valve having a central second land extending from each said inlet at each end inboard to alternately open each inlet to admit pressurized gas from the opposite primary piston to each secondary piston end and thereby increase gas pressure on a first side of the secondary piston moving toward the cylinder head for contact with the slide valve, while gas is exhausting from the opposite secondary piston end, to thereby permit gas pressure to move the slide valve fully in the opposite direction of movement of the second secondary piston end before the piston assembly reverses direction at the end of its reciprocating cycle.

5. The improvement of claim 4, wherein said first lands are sufficiently wide to maintain the outlet passages closed from first movement of the slide valve to the end of the cycle of the slide valve.

6. The improvement of claim 4, wherein said second land is of a width less than the width of the ports of the outlet passages communicating with the bore for the slide valve.

7. The improvement of claim 4, wherein snap rings adjacent the ends of the slide valve have a diameter larger than the slide valve bore to limit movement of the slide valve.

8. The improvement of claim 4, wherein the slide valve is cylindrical.

9. The improvement of claim 4, wherein said central passages in the ends of the slide valve have a port communicating in the volume adjacent the secondary piston ends.

* * * * *